US009580222B2

(12) United States Patent
Knutz et al.

(10) Patent No.: US 9,580,222 B2
(45) Date of Patent: Feb. 28, 2017

(54) ONSITE ADJUSTABLE PACKING CRATE SYSTEM

(71) Applicants: William Knutz, Curtis, WA (US); Tonie Knutz, Curtis, WA (US)

(72) Inventors: William Knutz, Curtis, WA (US); Tonie Knutz, Curtis, WA (US)

( * ) Notice: Subject to any disclaimer, the term of this patent is extended or adjusted under 35 U.S.C. 154(b) by 292 days.

(21) Appl. No.: 14/280,883

(22) Filed: May 19, 2014

(65) Prior Publication Data

US 2014/0346080 A1 Nov. 27, 2014

Related U.S. Application Data

(60) Provisional application No. 61/827,337, filed on May 24, 2013.

(51) Int. Cl.

| | |
|---|---|
| ***B65D 6/00*** | (2006.01) |
| ***B65D 81/107*** | (2006.01) |
| ***B65D 81/05*** | (2006.01) |
| ***B65D 6/02*** | (2006.01) |

(52) U.S. Cl.
CPC ..... *B65D 81/107* (2013.01); *B65D 9/06* (2013.01); *B65D 81/053* (2013.01); *B65D 2313/02* (2013.01)

(58) Field of Classification Search
CPC ..... B65D 81/107; B65D 81/05; B65D 81/02; B65D 81/053; B65D 81/054; B65D 9/00; B65D 9/06; B65D 9/12; B65D 9/22
See application file for complete search history.

(56) References Cited

U.S. PATENT DOCUMENTS

| | | | | |
|---|---|---|---|---|
| 4,958,759 | A * | 9/1990 | Jarvis | A45F 5/00 224/153 |
| 5,031,733 | A * | 7/1991 | Chang | A41D 15/04 190/1 |
| 7,455,339 | B2 * | 11/2008 | Staples | A45C 13/002 294/138 |
| 8,474,614 | B2 * | 7/2013 | Hanson | B65D 81/02 206/320 |
| 8,484,873 | B2 * | 7/2013 | Splittgerber | A47G 1/06 40/711 |
| 8,893,889 | B2 * | 11/2014 | Soukup | B65D 9/06 206/454 |
| 9,403,623 | B2 * | 8/2016 | Aaland | B65D 21/086 |
| 9,446,892 | B2 * | 9/2016 | Piscopo | B65D 81/055 |
| 2008/0131194 | A1 * | 6/2008 | Williams | B42D 3/045 402/73 |

* cited by examiner

*Primary Examiner* — Steven A. Reynolds
*Assistant Examiner* — Javier A Pagan
(74) *Attorney, Agent, or Firm* — Dean A Craine

(57) ABSTRACT

A crate system that includes a crate body that can be easily adjusted in size without hand tools. The crate body includes four width adjustable side walls, sandwiches between a lower planar support base and an upper top panel. Each side wall includes at least one lower side wall component affixed to the perimeter edge of the support base and at least one upper side wall component. The lower and upper side wall components and interconnected with pegs and holes to adjust the width of the side wall. Straps are extended around the side walls, support base and top panel to hold them together. The support base includes at least two rows of elongated slots that extend transversely and longitudinally over the support base and foam pads. A plurality of internal straps are inserted into one of the slots and automatically engage the slots when the straps are pulled upward.

7 Claims, 13 Drawing Sheets

ONSITE ADJUSTABLE PACKING CRATE SYSTEM

This utility patent application is based upon and claims the filing date benefit of U.S. Provisional patent application (Application No. 61/827,337) filed on May 24, 2013.

Notice is given that the following patent document contains original material subject to copyright protection. The copyright owner has no objection to the facsimile or digital download reproduction of all or part of the patent document but otherwise reserves all copyrights.

BACKGROUND OF THE INVENTION

1. Field of the Invention

This invention pertains to packaging used to transport large, fragile and valuable objects, such as office or household furniture, pictures, and electronic equipment, and more particular to shipping packaging adjustable in size and shape to accommodate different sizes and sizes of objects.

2. Description of the Related Art

Packing companies pack fragile furniture, office equipment, electrical equipment, wall hangings, personal items and loose household items. When the packing task is completed, a moving company then loads the cargo into a moving vehicle or container and transport the cargo to the desired destination.

When transporting fragile objects, rigid boxes or crates are often used to protect the objects. Protective padding is often placed around and in between the object and the top, bottom and side walls of the box or crate to isolate and hold the object in a central position inside the box or crate. Sometimes straps are used to hold the objects in a fixed position inside the box or crate.

Before packing, the furniture, equipment, wall hangings, sometimes have to be partially dissembled. The size of the shipping containers needed for the dissembled parts are difficult to determine beforehand. Usually, packers select the smallest empty box or container they have on hand that will accommodate the part. Often, the box or container is larger than needed causing the packer to add padding to fill empty spaces inside the box or crate or add strapping or bracing to prevent the object from moving inside the box or crate during transport. Because the box or crate is too large for the object, valuable cargo space is also wasted inside the moving vehicle or container.

Some objects, such as mirrors, glass table tops, flat screen televisions, framed pictures and large sculptures, should be stored and transported in one orientation. For example, mirrors, glass table tops, flat screen televisions, framed pictures and large sculptures should be stored and transported inside the container in a particular orientation. Packers usually will select a rigid box or crate that will accommodate the object and then spend considerable time strapping and bracing the object in the desired orientation inside the box or crate.

What is needed is a rigid shipping crate that can be easily adjusted in size to accommodate different sizes and shapes of objects without hand tools to accommodate different sizes of regular and irregular shaped objects.

SUMMARY OF THE INVENTION

The above mentioned needs are addressed by a size adjustable protective crate system disclosed therein that uses a crate body easily adjustable in size on-site, adjustable to accommodate different shaped objects, and does not require tools. The crate body includes at least four width adjustable side walls that temporarily attached to the four opposite edges of a rigid support panel and a rigid top panel. The support base is a flat planar structure upon which the object to be shipped is initially attached. In one embodiment, the support base includes a raised outer edge and a recessed central panel. When the support base is positioned on the floor, the support base is elevated above the floor to allow the proximal ends of internal straps that extend through holes in the support base to be easily manipulated.

Each side wall includes one lower side wall component affixed to the perimeter edge of the support base and at least one upper side wall component stacked in an edge-to-edge manner above the lower side wall component. The adjoining edges of the lower side wall component and the upper side wall component are aligned and registered with optional interconnecting holes and pegs or an abutment edge.

Attached to the outer four edges of the support base and the outer four edges of the top panel are a plurality of external straps. At least two external straps are attached to the support base and top panel and extend in opposite directions over the side wall to 'sandwich' the side walls between the support base and the top panel. During use, the external straps are extended over the adjacent side wall components to hold the two side components together and to connect them with the support base and the top panel. The length of each external strap is depended by the number of side wall components used. Each external strap includes a hook or loop pad near its free end. If both the lower and upper side wall components are used, the external straps must have a length sufficient to extend over both the lower and upper side wall components. When the upper side wall component is not used, the excess external strap may be folded into the crate.

Mounted or attached to the outer surfaces of the lower side wall component and the upper side wall component are at least four evenly spaced apart hook and loop pads. When assembled, the hook and loop pads on the external straps interconnect with the hook and loop pads on the lower and upper side wall components.

Disposed over the inside surface of the support base are a plurality of repositionable foam pads on which an object to be transported is placed. The foam pads are designed to be placed under a support structure, edge or surface on the object and support the object in an elevate position over the inside surface of the support base.

Attached to the support base are plurality of internal straps that extend around the object and hold it securely over the support base. In the embodiment shown herein, attached to the distal end of each internal strap is a hook or a flat end connector which slides into a elongated slot formed on the support base. The support base includes at least four sets of parallel elongated slots on opposite sides near the four adjacent side walls. Each set includes a plurality of elongated slots are parallel with the longitudinal axis of the adjacent side wall. The elongated slots are arranged in a side-by-side manner with the inside elongated slot being located inward and near the center point of the support base. During use, the user pulls the proximal end upward and around the object to change the direction of the pulling force over the object.

At least two sets of elongated internal straps as used with the crate system. When an object is placed over the resilient foam pads disposed over the inside surface of the support base, the internal straps are extended over the object to securely force the object against the resilient foam pads. Formed around each internal strap is an optional protective sleeve that presses against the contact edge or surface of the object when the internal strap is pulled over the object and tightly adjusted. During use, two internal straps are attached to two elongated slots on the support base and under and on opposite sides of the object. The straps are then tightly pulled upward, around the object, and interconnected.

The crate body is designed to be shipped in an assembled or partially unassembled into the desired configuration at the packing site. When the crate body is delivered to the shipping location, the size of the crate body is adjusted by removing or adding upper side wall components over the lower side wall components. The packer then determines the number and placement of the foam pads needed to support the object over the support base. The packer then places the object over the foam pads and then selects the number of internal straps needed and how they should be oriented to hold the object in place over the support base. The packer then adjusts the connection locations or slots on support base. The loose distal ends of the internal straps on opposite sides of the object are then interconnected to hold the object in a fix location on the support base. Additional internal straps are then selectively extended over the object to hold it on the support base. Next, the top panel is then placed over the top edges of the upper side wall components and the external straps are attached to interconnect the lower support base, top panel and the side wall components.

DESCRIPTION OF THE PREFERRED EMBODIMENT(S)

Figure 1:
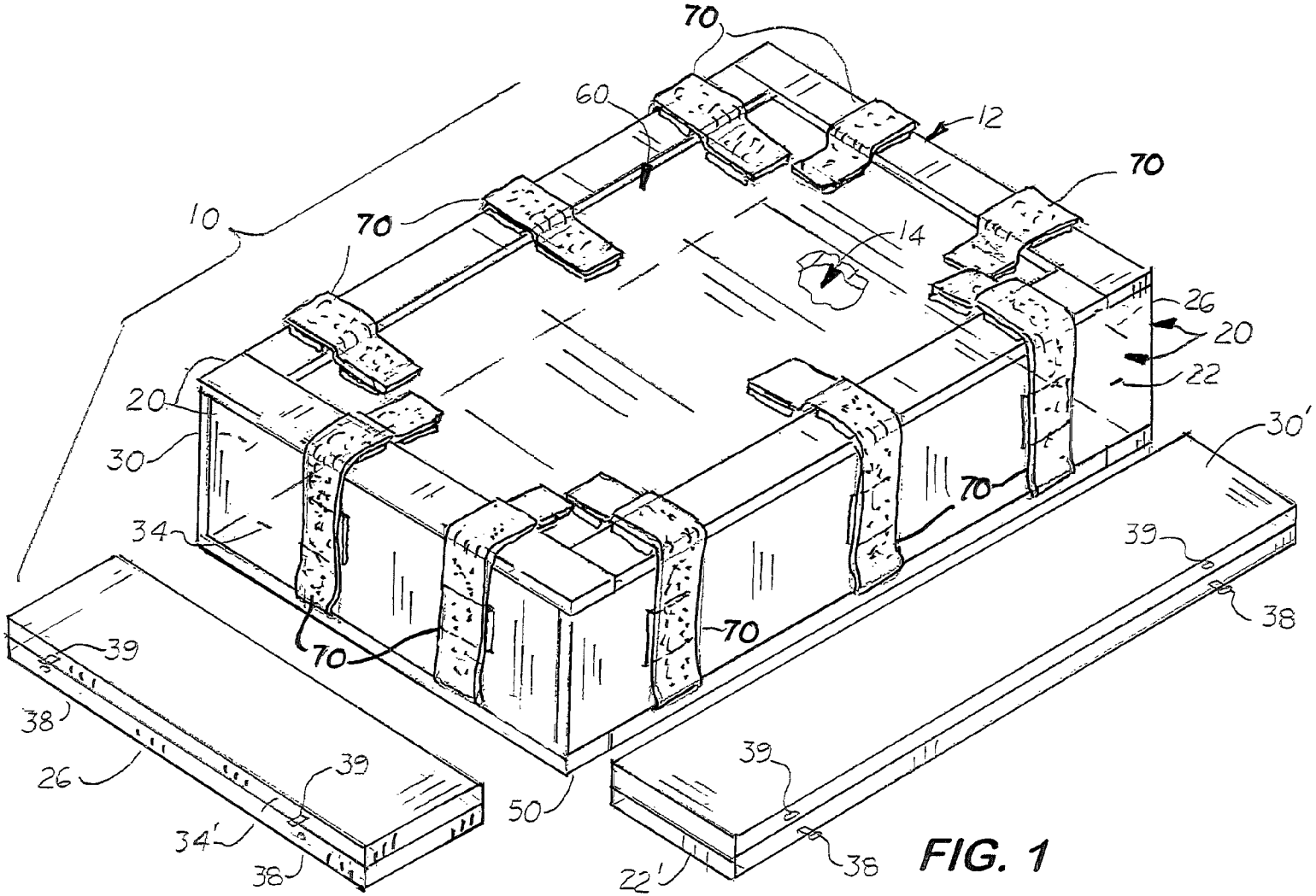
FIG. 1 is a perspective view of one embodiment of the size adjustable crate disclosed herein.
Figure 2:
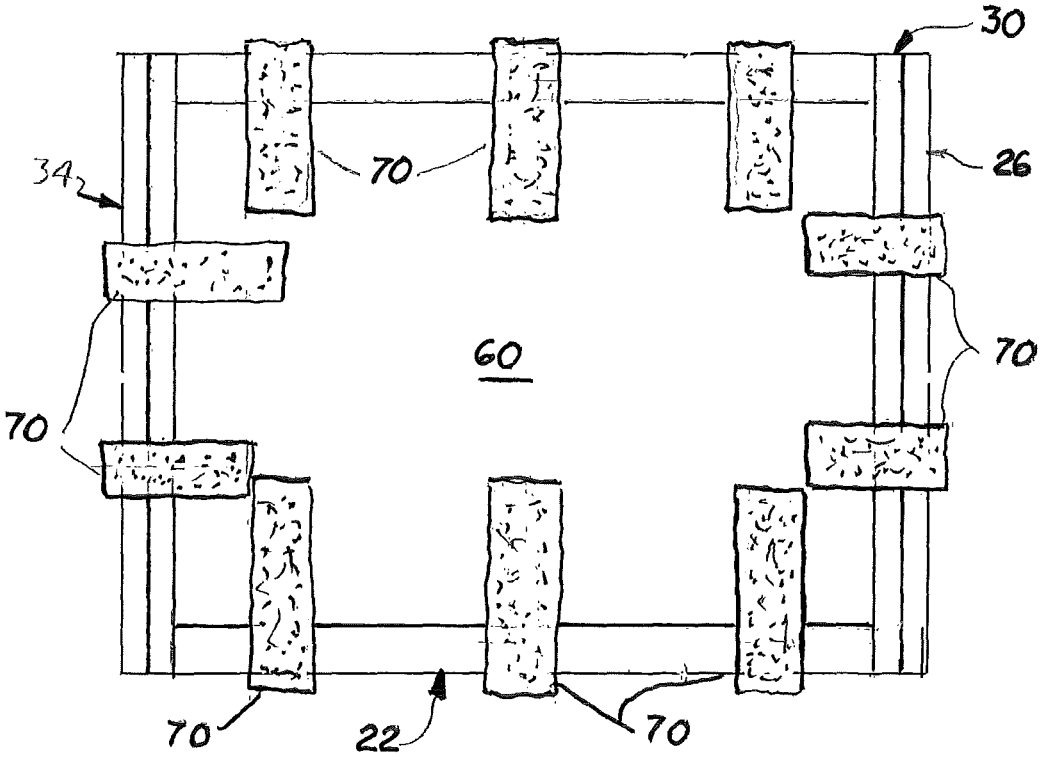
FIG. 2 is a top plan view of the crate.
Figure 3:
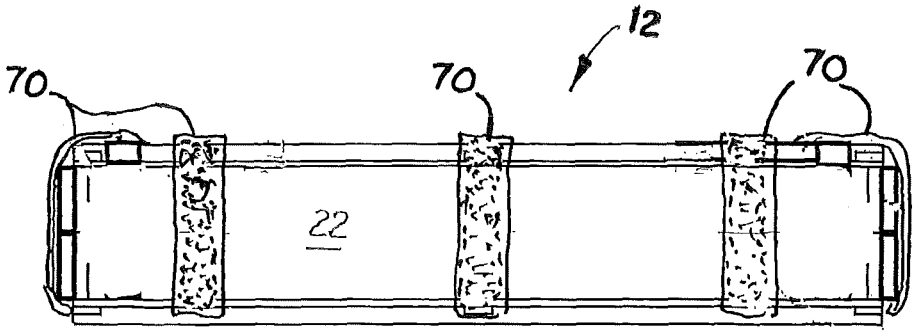
FIG. 3 is a side elevation view of the crate.

Disclosed herein is a size adjustable protective crate system 10 that allows a packer to selectively assemble and form different size crate bodies 12 to receive and protect different sizes of regular and irregular objects. Each crate body 12 includes a rigid support base 50, a top panel 60 and at least two sets of four removable side walls indicated by the reference numbers 20, 20' and includes lower side wall components 22, 26, 30, 34 and upper side wall components 22', 26', 30' and 34' respectively. FIG. 1 shows one set of four side walls 20 (lower side wall components 22, 26, 30, 34) installed on the crate body 12 and the second set of side walls 20' (upper side wall components 22', 26' 30', and 34') and stacked to one side.

In the embodiments shown in the Figs, the long side wall components 22, 22', 30 and 30' are identical in length (43 inches) and width (5 inches). The short side wall components 26, 26' 34, and 34' are also identical in length 43 inches and width (5 inches). It should be understood, however, that three or four sets of four side walls components may be provided and the lengths and widths of the long and short side wall components may also vary.

The lower side wall components 22, 26, 30, 34 and the upper side wall components 22', 26', 30' 34' are registered with the inside surfaces and the perimeter edges of the support base 50 and the top panel 60. To keep the lower edges of the lower side wall components 22, 26, 30, 34 and upper side wall components 22', 26', 30', 34' aligned with the adjacent perimeter edges, at least one pair of pegs 38 and at least one pair of holes 39 are formed on the adjoining longitudinal edges of the lower side wall components 22, 26, 30, and 34 and the upper side wall components 22', 26', 30' and 34' on the top surface of the support base 50 and the bottom surface of the top panel 60. During assembly, the pegs 38 and holes 39 are aligned at registered. Similar pegs 38 and holes 39 may attached and formed on the adjoining edges of the lower and upper side wall components (22, 26, 30, 34 and 22', 26', 30' and 34') to keep them vertically aligned.

Extending over the outside surfaces of the four lower side wall components 22, 26, 30, and 34 is a plurality of length adjustable external straps 70, 70' with hook or loop connectors 72 attached on one side to their distal ends. The opposite, proximal ends of the lower external straps 70 are affixed to the perimeter edges of the support base 50 and the proximal end of the upper external strap 70' is attached to the perimeter edges of the top panel 60. The external straps 70, 70' are perpendicularly aligned with the perimeter edges and are sufficient in size to extend over the adjoining side wall components. The actual lengths of each external strap 70, 70' is depended by the number of side wall components distributed with the crate system 10. If both sets of side walls 20, 20' are distributed, then the external straps 70, 70' must have a length to extend upward and downward over both the lower and upper side wall components when stacked in an edge to edge manner. When the upper side wall components are used the excess external strap 70, 70' may be folded into the crate.

Mounted on the outside surface of the lower and upper side wall components 22, 22' and 26, 26' and 30, 30', and 34, 34' are hook and loop connector pads 37 compatible with the hook and loop connectors 72 attached to the distal ends of the external straps 70. The hook and loop connector pads 37 are positioned on the exterior surface of the side wall components so they are engaged by the hook and loop connectors 72 when the external straps 70, 70' are pulled over the side wall components 22, 26, 30, 34.

FIGS. 7-11 show a second embodiment of the crate system 10' with both sets of side wall 20, 20' to create a crate with a tall crate with a wide internal cavity. In this embodiment, the adjoining ends of the side wall components 22, 22', 26, 26', 30, 30', 36, and 36' are offset and 'dovetailed' together enabling the ends of the side wall components 22, 22', 26, 26', 30, 30', 36, and 36' to be aligned.

Figure 5:
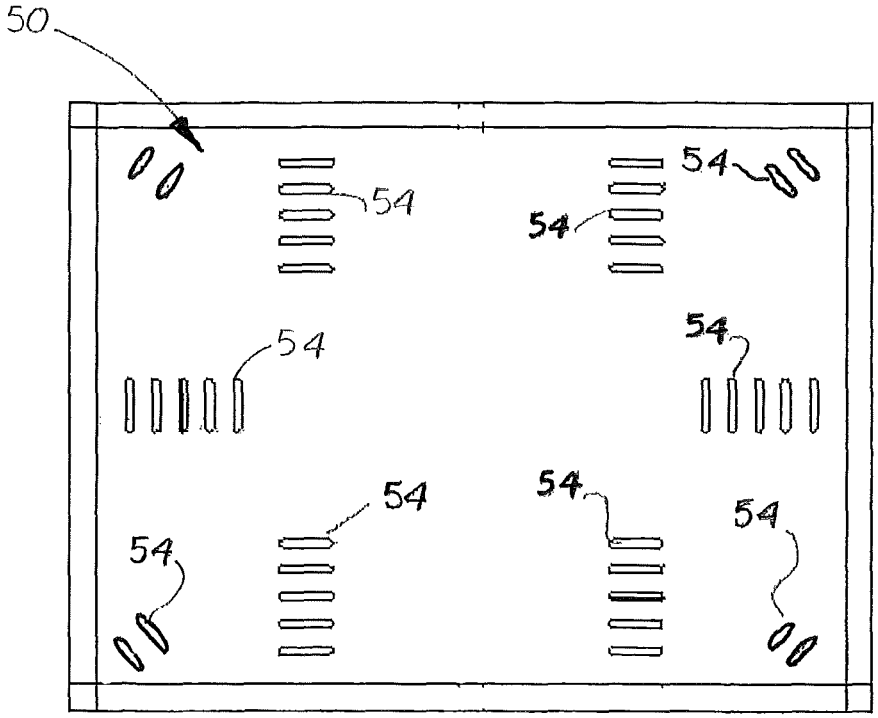
FIG. 5 is a bottom plan view of the support base.
Figure 6:
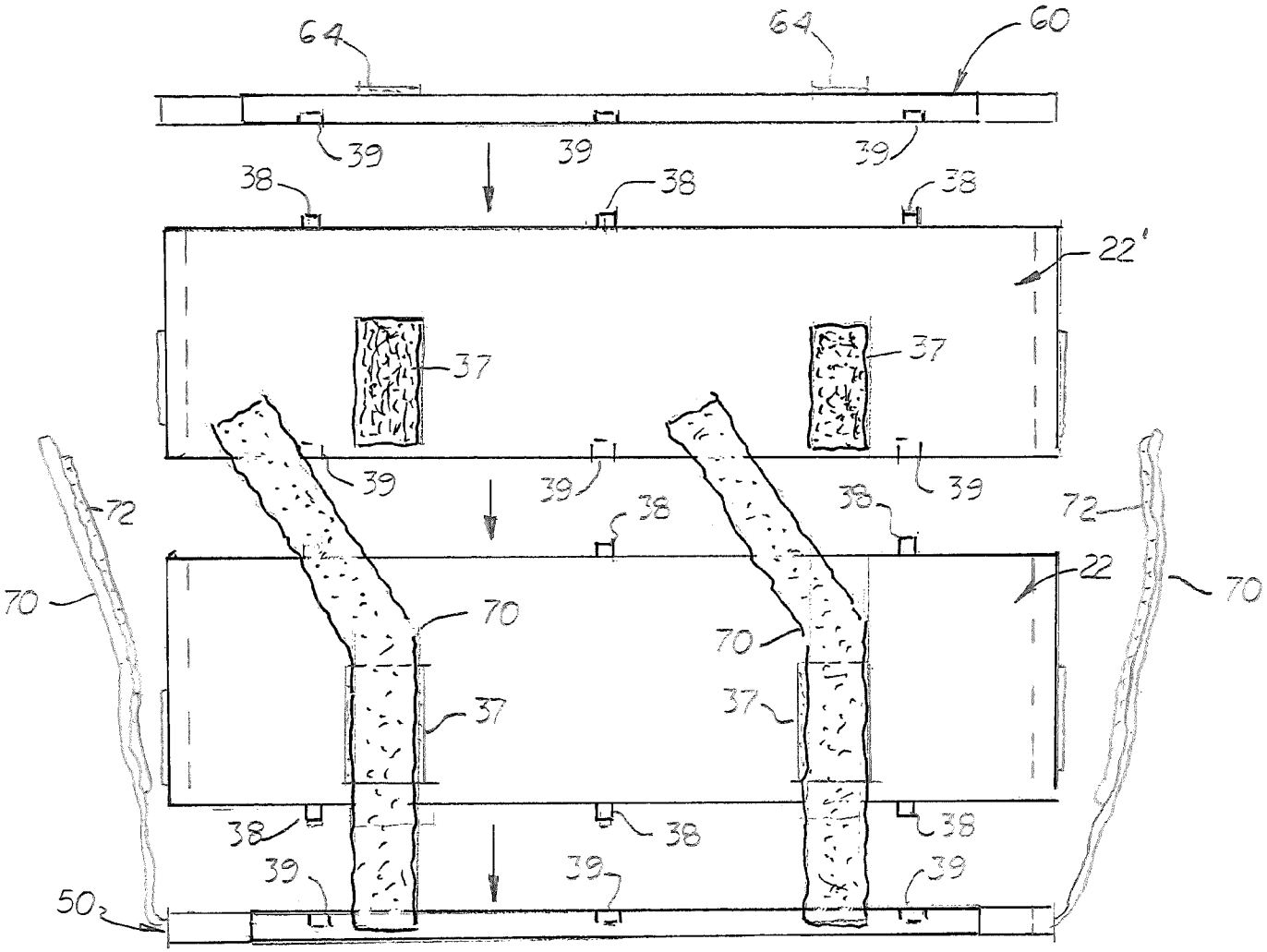
FIG. 6 is an exploded side elevation view of the crate with two stacked side wall components.
Figure 9:
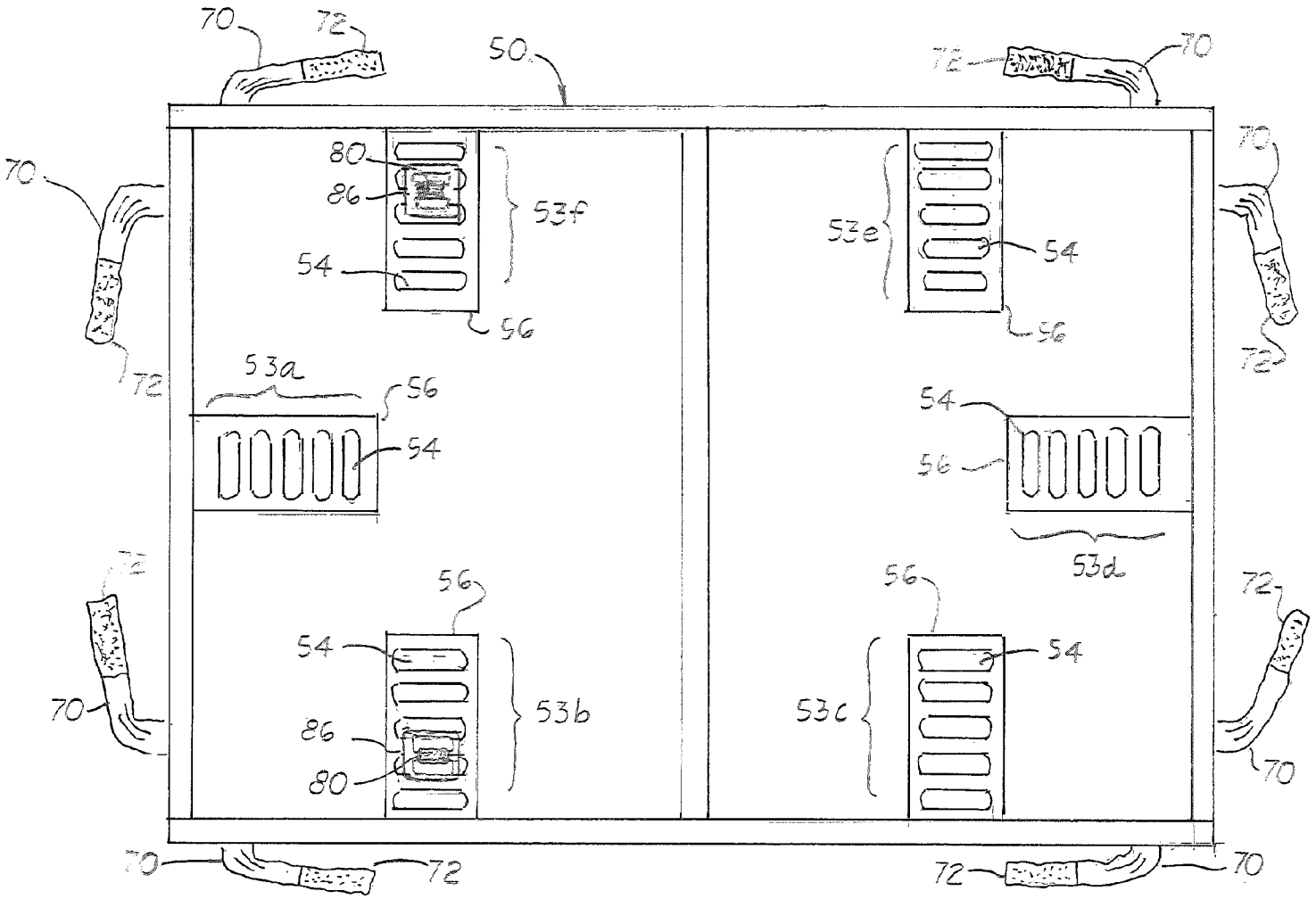
FIG. 9 is a bottom plan view of the crate shown in FIGS. 7 and 8
Figure 10:
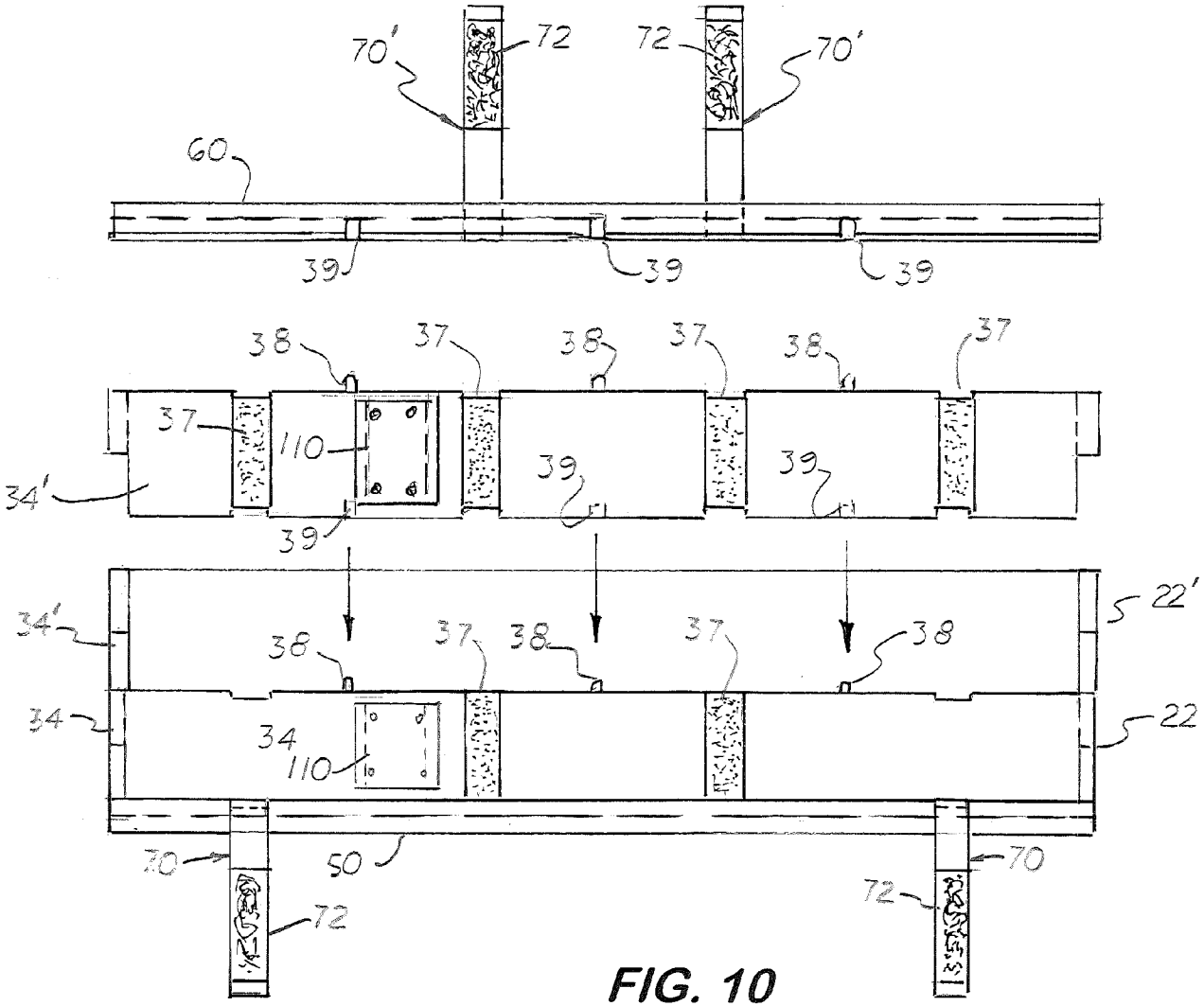
FIG. 10 is an exploded end elevational view of the crate shown in FIGS. 7-9
Figure 11:
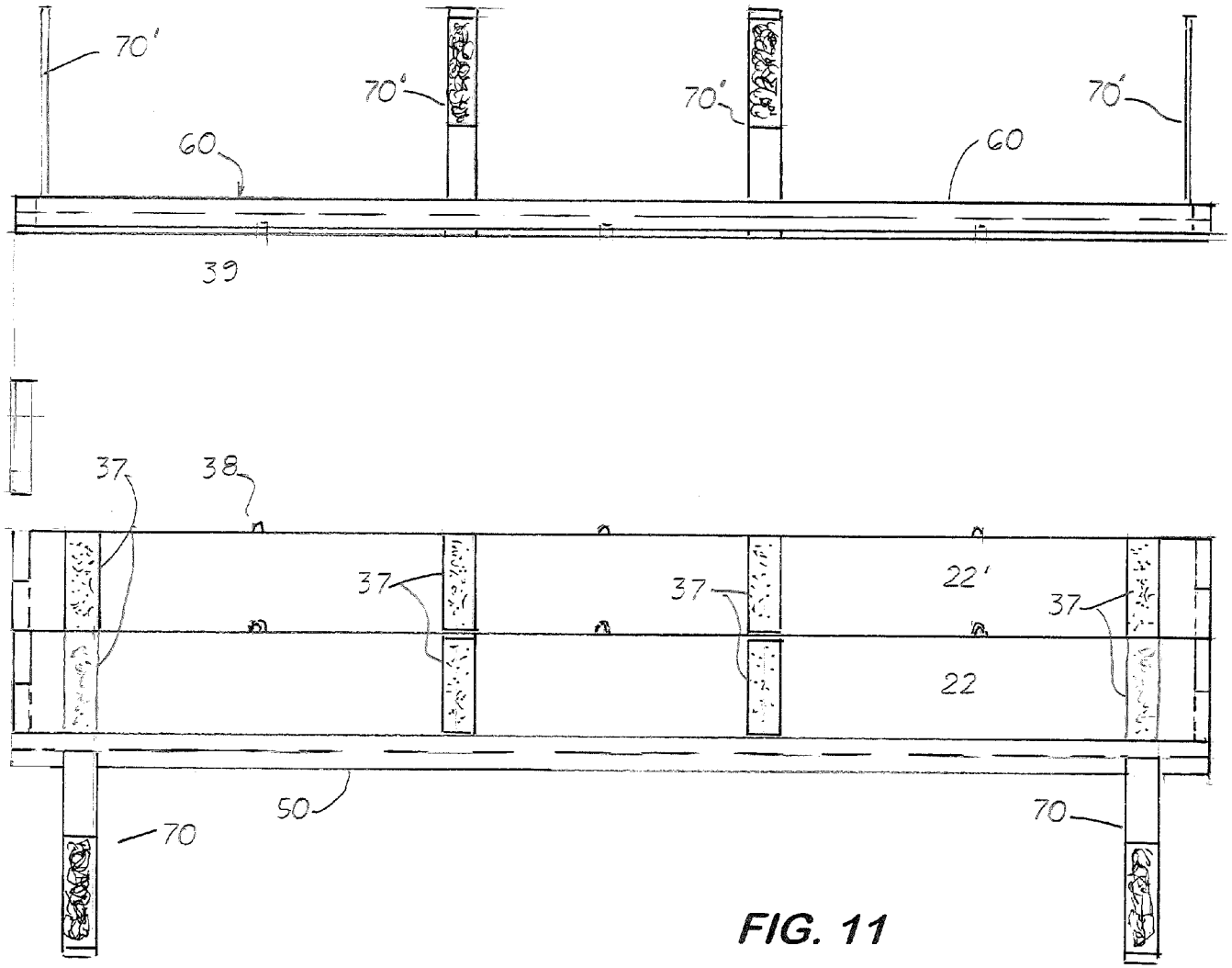
FIG. 11 is an exploded side elevational view of the crate shown in FIGS. 7-10.
Figure 12:
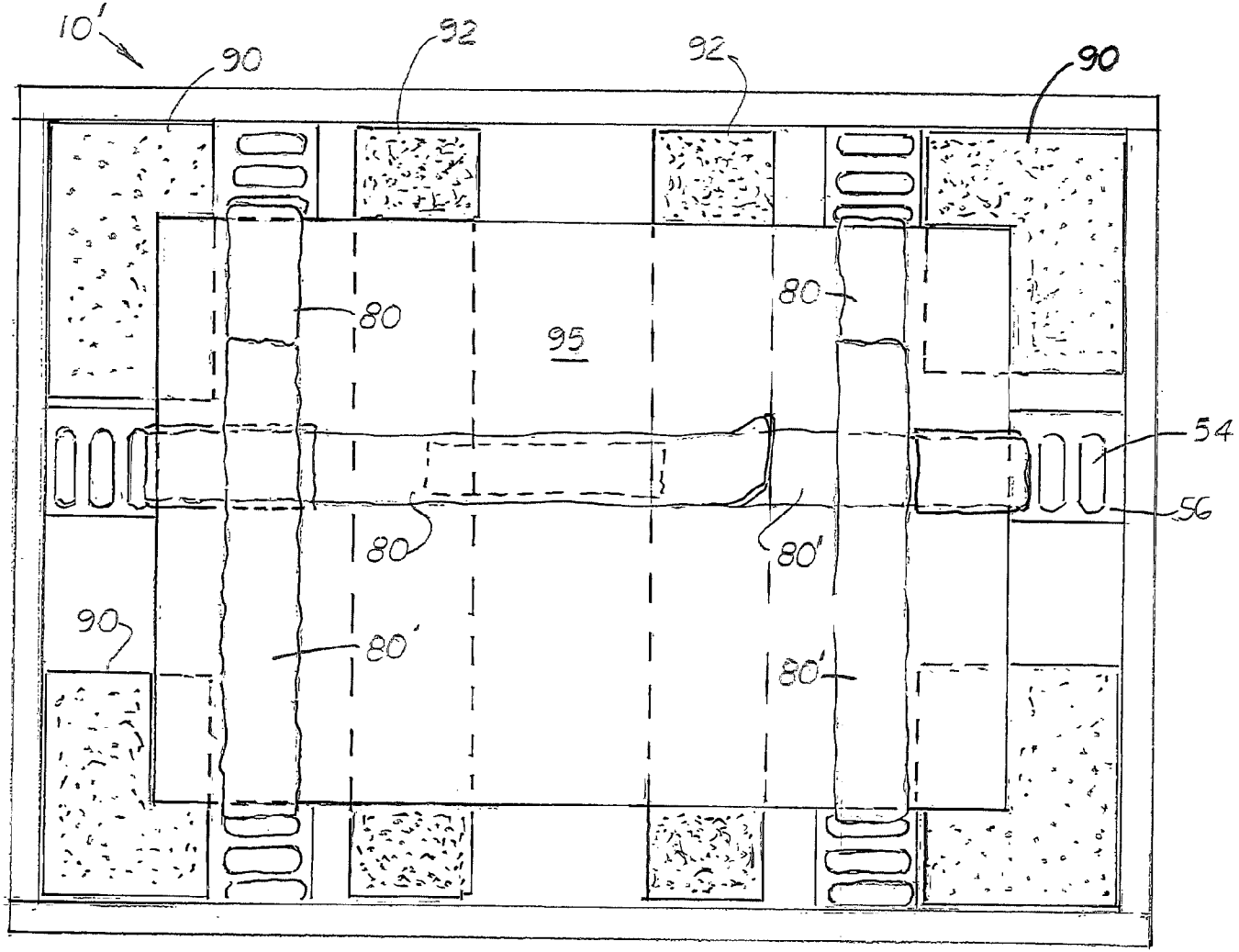
FIG. 12 is a top plan view of the crate showing a flat mirror located inside the crate and securely held by three straps.
Figure 14:
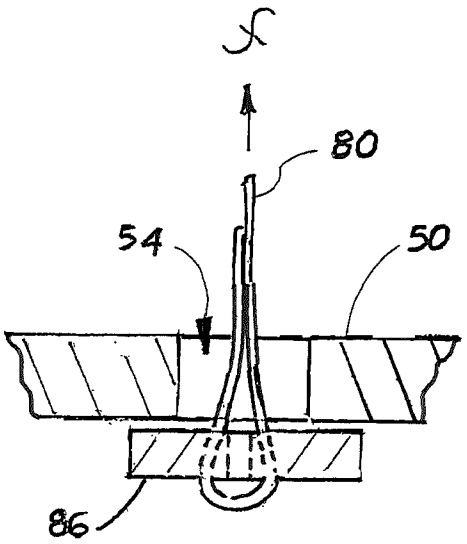
FIG. 14 is a sectional side elevation view of the support base showing an upward force being applied to the internal strap which causes the end connector to rotate into a blocking position.
Figure 13:
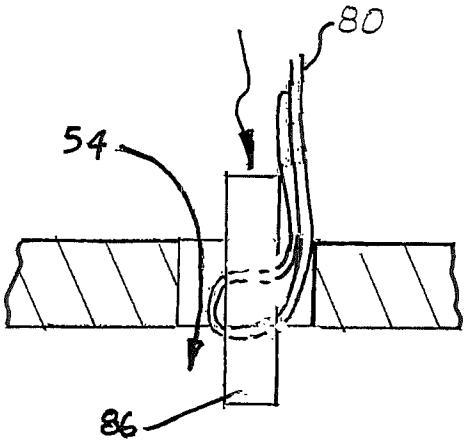
FIG. 13 is a sectional side elevation view of the support base showing the end connector attached to an internal strap being perpendicularly aligned and inserted through the slot.

As shown in FIGS. 5 and 9, the support base 50 includes six groups of elongated slots, (indicated as 53*a-f*). Each group 53*a-f* includes a plurality of parallel elongated slots 54 aligned transversely and longitudinally over the support base 50. In one embodiment, the group of slots includes a plurality of elongated slots 54 may be manufactured directly into the support base 50 as show in FIG. 5 or they may be manufactured into a slot plate 56 separately attached to the support base 50 as shown in FIG. 9. The groups 53*a-f* or the slot plates 56 are located near the outer perimeter edges of the support base 50 and extend inward and perpendicularly from the perimeter edge. The slots 54 are approximate 3 inches in length, and 1 inch in width.

Figure 7:
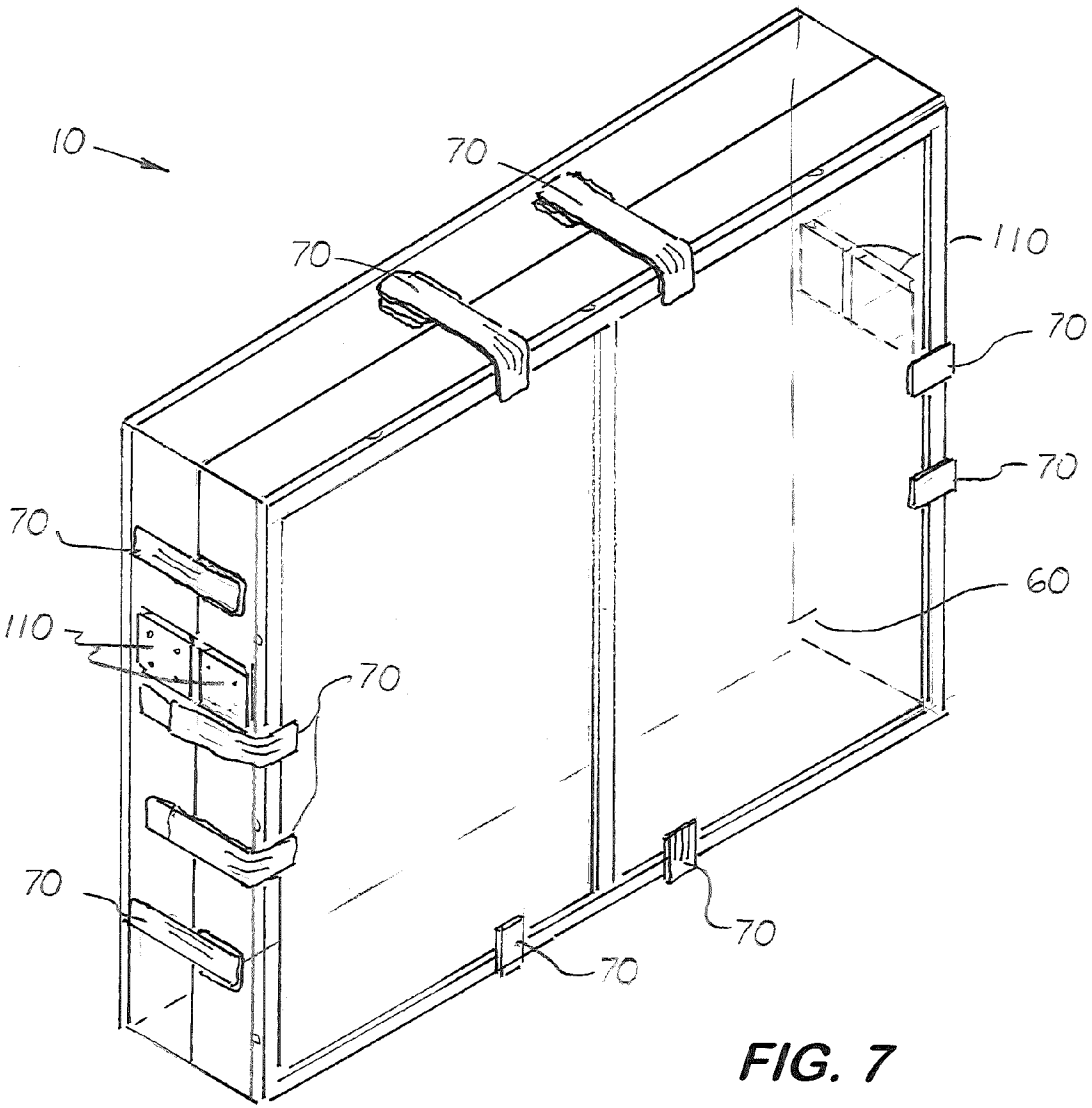
FIG. 7 is a perspective view of another embodiment of the adjustable crate.
Figure 8:
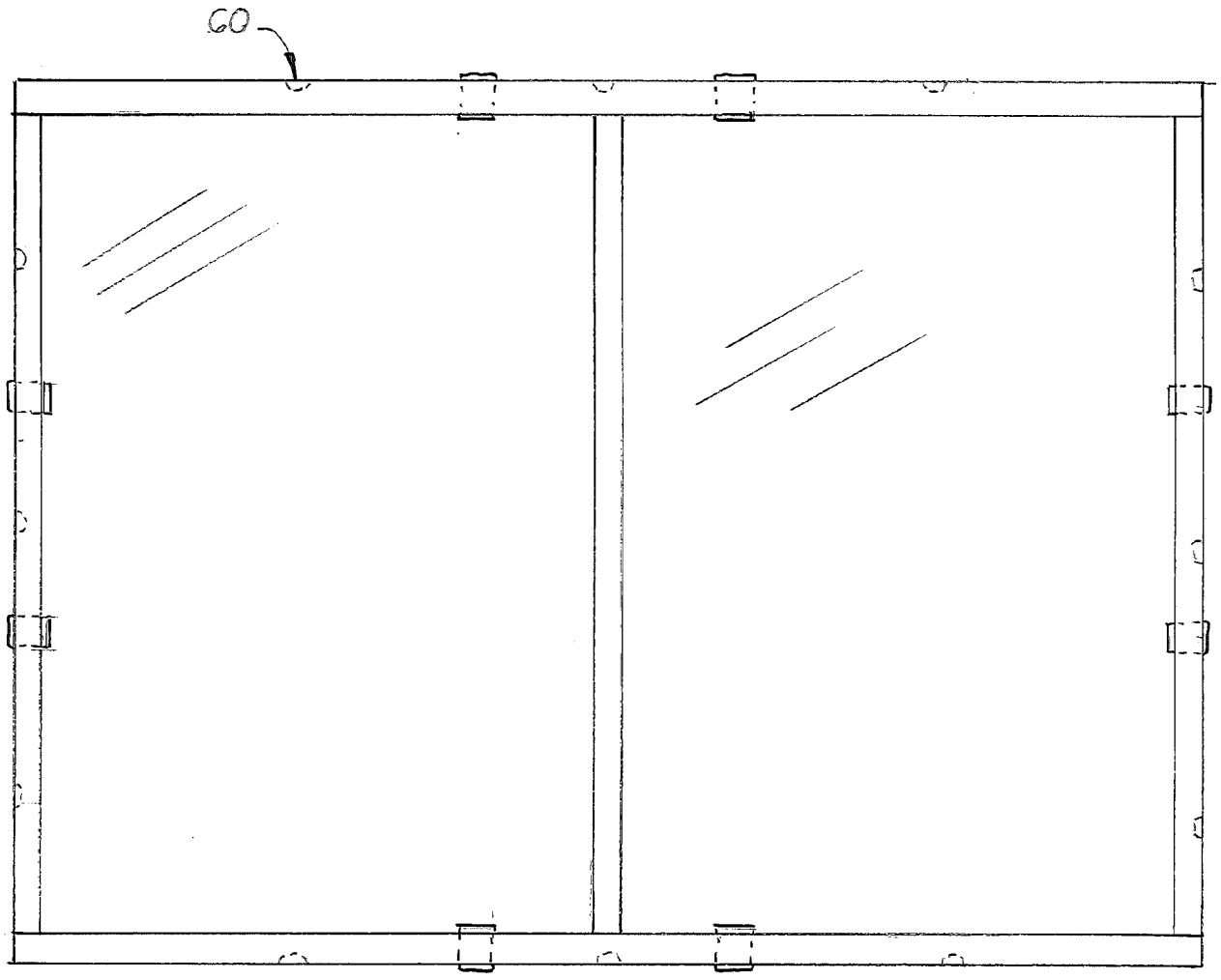
FIG. 8 is a top plan view of the crate shown in FIG. 7.

Connected to the slots 54 are a plurality of internal straps 80 that extend across an object 95 disposed over the support base 50. In the embodiment, each internal strap 80 includes a flat plate end connector 86 that can be rotated on edge and easily inserted into a slot 54 as shown in FIG. 7. After the end contactor 86 is extended through the slot 54, then rotated 90 degrees and positioned against the bottom surface of the support base 50. When the end of the internal strap 80 is pulled upward, the end connector 86 prevents the lower end of the internal strap 80 from disengaging from the support base 50. In the embodiment shown in FIGS. 7 and 15, the end connector 86 is slightly concave.

Also shown in FIG. 7 are two pairs, of low profile hand grips 110 attached to opposite said side wall components.

Figure 4:
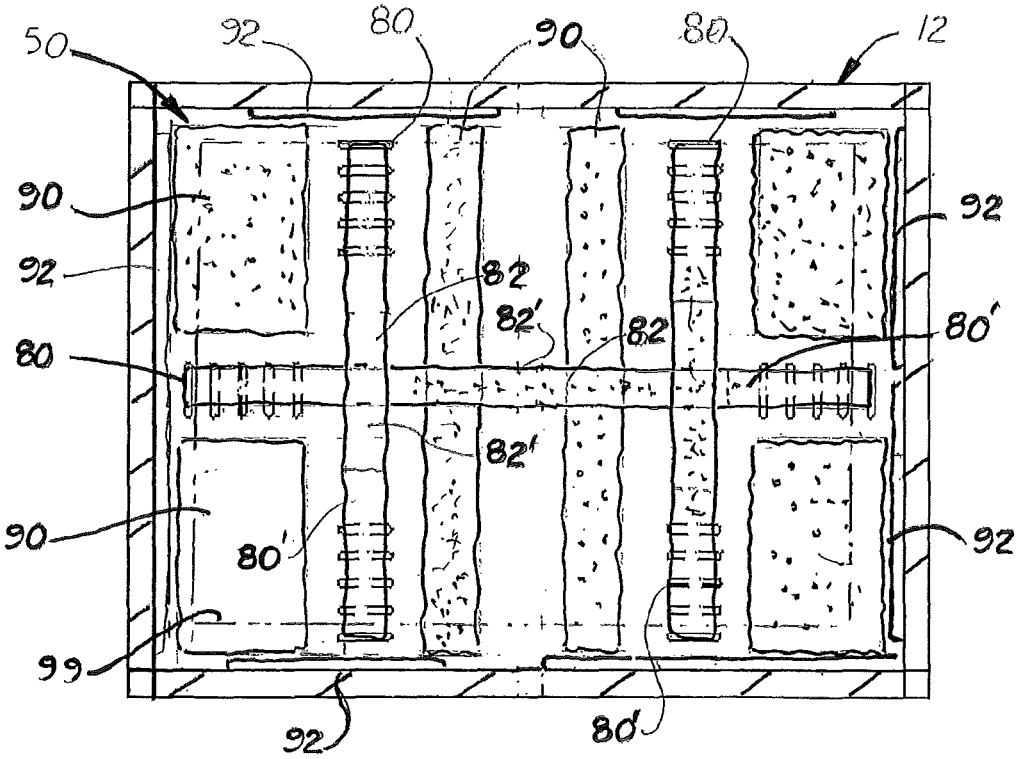
FIG. 4 is a top plan view of the support base showing one longitudinally aligned internal strap and two transversely aligned internal straps and four foam blocks mounted in the corners.
Figure 15:
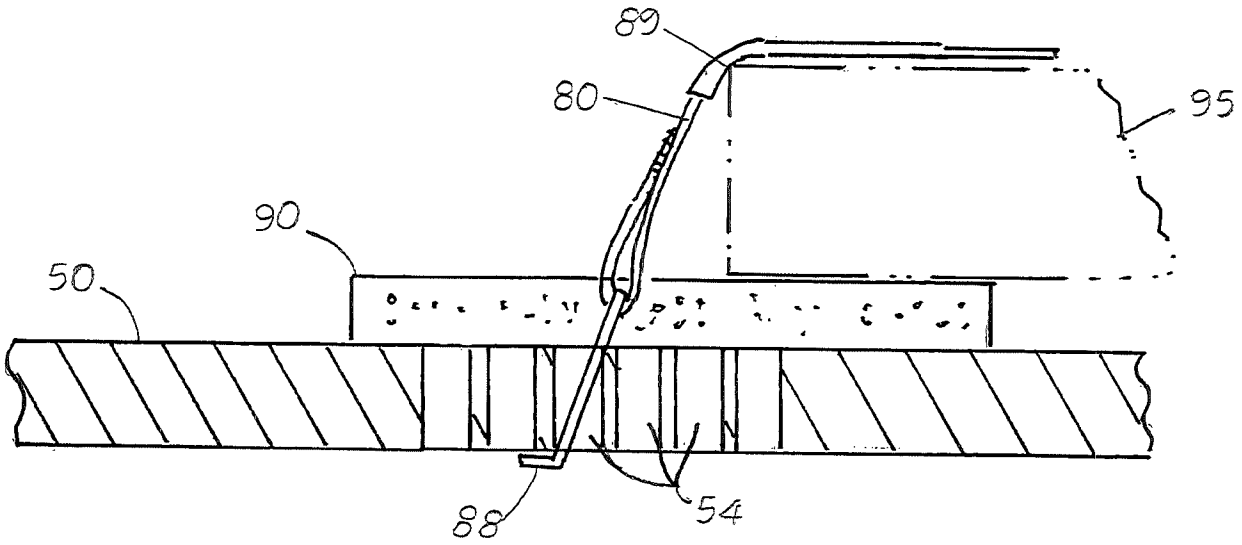
FIG. 15 is a sectional elevational view of an object disposed over a foam block and held on in a fixed position of the support base by an internal strap with a hook attached to the end of the internal strap that engages a slot formed on the support base.
Figure 16:
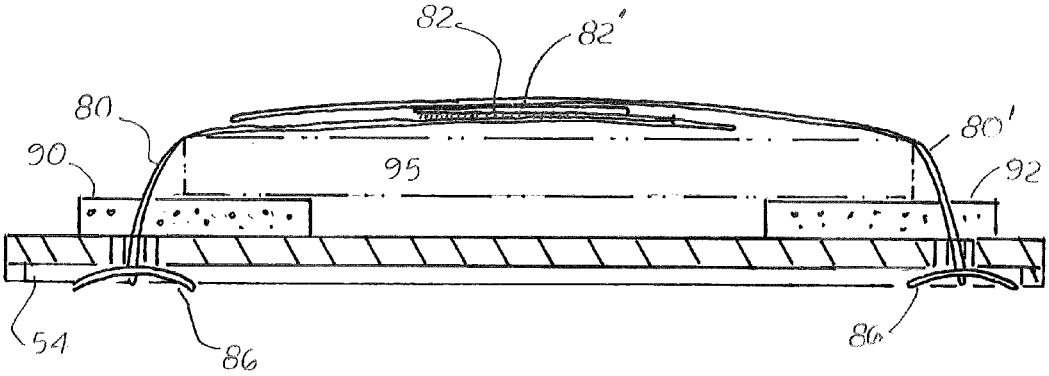
FIG. 16 is a sectional elevational view of an object disposed over two foam blocks and held on in a fixed position of the support base by an two overlapping internal straps.

When an object 99 is placed on the support base 50, a second internal strap 80' may be connected to a slot 54 on the support member 50 on the opposite side of the object 95. Each internal strap 80, 80' includes a compatible hook or loop connector 82, 82' attached to the inside surfaces that allows the loose ends of the secondary straps 80, 80' when overlapped to be selectively connected together to hold the object 95 tightly in a fixed position on the support base 50. As shown in FIGS. 4, 15, and 16, attached to the inside surfaces of the support base 50, and the side walls 22, 26, 30, and 34 are option protective foam blocks 90, 92, respectively, that elevates the object 955 above the support base 50

FIG. 15 is a sectional elevational view of an object 95 disposed over two foam blocks 90, 92 and held on in a fixed position of the support base 50 by an internal strap 80 with a hook style end connector 88 attached to the end of the internal strap 80 that engages a slot 54 formed on the support base 50.

FIG. 16 is a sectional elevational view of an object 95 disposed over two foam blocks 90, 92 and held on in a fixed position of the support base 50 by two overlapping internal straps 80, 80'.

The crate 10, 10' is designed to be shipped in an unassembled configuration and assembled just prior to use. The crate system 10, 10' may also include additional third and fourth sets of four side stacked and longitudinally aligned with the first and second set of side walls 20, 20' that enable the user to adjust the overall height of the crate body 12. After unpacking, the crate body 12 can be easily dissembled and returned to a collapsed configuration and reused.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

We claim:

1. A size adjustable crate system, comprising;

a. a support base with four straight perimeter edges, an inside surface and an outside surface;

b. a top panel with four straight perimeter edges, an inside surface and an outside surface, said top panel being substantially the same size and shape as said support base and located above and aligned parallel to said support base;

c. four rigid side walls disposed between said support base and said top panel, each said side wall includes an exterior surface and a straight lower edge and a straight upper edge parallel to the support surface, said side walls being perpendicularly aligned with said inside surface on said support base and perpendicularly aligned with said inside surface of said top panel, each said side walls being the same width and configured to be aligned on one edge on said support base, each said side wall includes two or more side wall components, each side wall component used in each said side wall being the same lengths and configured to be stacked together along one edge thereby enabling the overall height of each said side wall to be adjusted, said number of side wall components used in each said side wall being the same so that all of said side walls are the same width;

d. a plurality of pegs and peg holes formed on the adjoining edges of said edges of said side wall components enabling stacked side walls components to be locked together;

e. a plurality of first exterior straps extending between said support base and said side walls, each said external straps include a proximal end affixed to said support base and a distal end selectively affixed to said exterior surface on said side walls;

f. a plurality of second exterior straps extending between said top panel and said side walls, said external straps include a proximal end affixed to said top panel and a distal end selectively affixed to said exterior surface on said side wall;

g. a plurality of elongated slots formed on said support base and inside said perimeter edges;

h. a first set of hook or loop connector pads attached to said inside surface of said support base; and i. a plurality of elongated interior straps, each said interior strap includes an end connector configured to be inserted when aligned in one way into one of said elongated slots formed on said support base, said end connector configured to resist removal from said slot when extended through said slot when rotated into a blocking position, each said interior strap also includes second set of hook or loop connector pads configured to attach to a first set of hook or loop connectors attached to said support base, whereby when said end connector on said interior strap is inserted into said slot and rotated to a blocking position and said interior strap is extended around an object, the hook or loop connectors on said interior strap attaches to a first set of hook or loop connectors on said support base to securely hold said object in a fixed position on said support base.

2. The crate system, as recited in claim 1, further a plurality of foam blocks disposed over said support base and between said object and said side walls.

3. The crate system, as recited in claim 1, further includes at least one hand grip attached two opposite said side walls.

4. The crate system, as recited in claim 1, wherein said end connector is a flat plate configured to be rotated on edge and inserted into said slot and then rotated 90 degrees into a blocking position.

5. The crate system, as recited in claim 1, wherein said end connector is a hook configured to engage said slot when an opposing force is exerted on said interior strap.

6. The crate system, as recited in claim 1 wherein each said side wall component has opposite ends that are offset thereby enabling ends on adjoining side wall components to be dovetailed together.

7. The crate system, as recited in claim 1, further including said support base is configured with said bottom surface elevated when said bottom surface is placed on a horizontal surface enabling said end connector to engage said slot.

* * * * *